US005544385A

United States Patent [19]

Jailor et al.

[11] Patent Number: 5,544,385

[45] Date of Patent: Aug. 13, 1996

[54] FILTER BAG MOUNTING ASSEMBLY FOR A VACUUM CLEANER

[75] Inventors: John Jailor, Rockford; William H. Frederick, Grandville; Steven R. Umbach, East Grand Rapids; Scott R. Graham, Zeeland; Kenneth L. Roberts, Battle Creek; Eric R. Metzger, Sand Lake, all of Mich.

[73] Assignee: Bissell Inc., Grand Rapids, Mich.

[21] Appl. No.: 421,403

[22] Filed: Apr. 13, 1996

[51] Int. Cl.[6] ..... A47L 5/28; A47L 9/14

[52] U.S. Cl. ..... 15/350; 15/351; 55/376; 55/378

[58] Field of Search ..... 15/350, 351, 327.2; 55/374, 376, 378

[56] References Cited

U.S. PATENT DOCUMENTS

| | | | |
|---|---|---|---|
| 2,804,164 | 8/1957 | Brace | 55/376 |
| 2,975,862 | 3/1961 | Goldberg | 55/376 |
| 3,651,536 | 3/1972 | Bolzan et al. | 15/327.2 X |
| 3,683,599 | 8/1972 | Malz | 55/376 |
| 4,262,384 | 4/1981 | Bowers . | |
| 4,469,498 | 9/1984 | Fish . | |
| 4,539,026 | 9/1985 | Kuplas . | |
| 4,591,369 | 5/1986 | Stewart et al. | 55/378 X |
| 4,621,390 | 11/1986 | Hampton et al. . | |
| 4,670,937 | 6/1987 | Sumerau et al. . | |
| 4,748,713 | 6/1988 | Sepke et al. . | |
| 4,955,106 | 9/1990 | Stein et al. . | |
| 5,089,038 | 2/1992 | Kopco et al. . | |
| 5,092,915 | 3/1992 | Lackner | 55/378 X |
| 5,223,010 | 6/1993 | Saunders et al. . | |

*Primary Examiner*—Chris K. Moore

*Attorney, Agent, or Firm*—Varnum, Riddering, Schmidt & Howlett LLP

[57] ABSTRACT

A vacuum cleaner filter bag mounting assembly comprises a bag mounting member having a fixed plate which is secured to a housing of a vacuum cleaner and a hinge plate which is pivotally mounted to the fixed plate through a living hinge. A channel is formed on the outside surface of the hinge plate for a receipt of the vacuum bag collar and an air deflector extends outwardly from the fixed plate for insertion into the filter bag. The bag mounting member is preferably integrally molded from a single injection-molding operation. An outlet tube is integrally molded to the fixed plate and has bag-retaining projections on an outer surface and a deflector at the end to deflect particles downwardly into the filter bag. The filter bag is retained in the operating condition by the bag-retaining projections on the outlet tube.

14 Claims, 4 Drawing Sheets

FILTER BAG MOUNTING ASSEMBLY FOR A VACUUM CLEANER

BACKGROUND OF THE INVENTION

1. Field of the Invention

This invention relates to vacuum cleaners and, more particularly, to a mounting for a vacuum cleaner filter bag.

2. Description of Related Art

Paper filter bags have been mounted inside a cleaner housing for capturing dirt and dust entrained in the air flow from a dirt collecting nozzle. Typically, the dirty air is delivered by a conduit to an enclosed rigid housing or flexible bag in which the dirty air is directed. In some upright vacuum cleaners, the dirty air is drawn or forced through a rigid housing in which the air is filtered. In other upright vacuum cleaners, the dirty air is forced under pressure into a flexible cloth bag which filters the air. Disposable paper bags can be mounted to outlet tubes in the flexible cloth bags and the rigid housings to collect the dust and dirt. A typical filter bag has an aperture formed therein for receiving the dirt and dust from the working air channel. A cardboard collar typically surrounds the aperture. The collar may have a contoured configuration which is received in a suitable channel mounting secured to the housing of the vacuum cleaner. The channel mounting may be rotatable to seat the filter bag apertures over the dirty air. Examples of such bag mounting systems for upright vacuum cleaners are disclosed in U.S. Pat. No. 5,089,038, issued Feb. 18, 1992; U.S. Pat. No. 5,223,011, issued Jun. 29, 1993; U.S. Pat. No. 4,955,106, issued Sep. 11, 1990; U.S. Pat. No. 4,670,937, issued Jun. 9, 1987; U.S. Pat. No. 4,262,384, issued Apr. 21, 1981; and U.S. Pat. No. 4,539,026, issued Sep. 3, 1985. A similar bag-mounting system without a channel mounting is disclosed in the U.S. Pat. No. 3,683,599, issued Aug. 15, 1972.

Two significant problems in the upright vacuum cleaner bag mountings are the cost and complexity of the bag mounting system and the difficulty average consumers experience in properly installing the bag. A challenge faced by the industry is designing a cost-effective filter bag mounting which is intuitive to the customer for mounting the bag on the dirty air outlet housing and which can be quickly and easily installed by the average consumer. Several of the known prior art upright filter bag mounting systems are complex, relatively expensive to manufacture, are not intuitive to the customer or are not reliably alignable.

SUMMARY OF INVENTION

The filter bag mounting assembly according to the invention overcomes the problems of the prior art with a simple, cost-effective filter bag mounting assembly which is highly intuitive for the user. The invention relates to a vacuum cleaner wherein a working air conduit extends from a suction nozzle to a filter enclosure and defines a working air flow path therebetween in a housing. A vacuum motor in the housing is connected to the working air conduit and is adapted to draw air from the nozzle through the working air conduit and force air into the filter enclosure. A filter bag has an aperture formed therein to filter dirt from dirt-laden air and a mounting collar which surrounds the aperture. A first mounting member is mounted to the vacuum housing and has an outlet opening coupled to the working air conduit. A second mounting member removably mounts the filter bag. A hinge pivotably interconnects the first and second mounting members for rotational movement of the second mounting member with respect to the first mounting member between a first position wherein the filter bag aperture is in fluid communication with the first mounting member outlet opening and a second position wherein the filter bag aperture is pivoted out of fluid communication with the outlet opening for removal and replacement of the filter bag. In accordance with the invention, the hinge is integrally molded with the first and second mounting member. Further, according to the invention, the first member outlet opening comprises an outlet tube mounted to and extending from the working air conduit and into the filter enclosure. The outlet tube has at an outer end a deflector to change the direction of air passing through the outlet tube to prevent particles entrained in the air from damaging the filter bag. Preferably, the second mounting member has formed therein a conduit aperture which receives the outlet tube when the second mounting member is rotated to the first position.

In accordance with a preferred embodiment of the invention, the filter bag aperture has a first diameter and the outlet tube has at least one bag-retaining projection extending outwardly therefrom. The at least one projection and the air conduit define a second diameter which is slightly smaller than the first diameter of the filter bag aperture. The at least one projection is mounted on the air conduit so that the air conduit aperture of the bag slides over the at least one projection when the second mounting member is pivoted between the first and second positions. The frictional interference between the filter bag and the at least one projection is sufficient to retain the second mounting member in the first position during normal operating conditions of the vacuum cleaner.

Further in accordance with a preferred embodiment of the invention, at least one mounting tab extends laterally from one of the housing and the first mounting member and at least one mounting tab aperture is formed in the other of the housing and the first mounting member. The at least one mounting tab is received in the at least one aperture to mount the first mounting member to the housing. The at least one mounting tab comprises a flexible shaft extending outwardly from the one of the housing and first mounting member and a locking head on the other end of the shaft is received in the at least one mounting tab aperture for snap locking of the first mounting member and housing to one another.

BRIEF DESCRIPTION OF THE DRAWINGS

The invention will now be described with reference to the drawings in which.

DESCRIPTION OF THE PREFERRED EMBODIMENTS

Figure 1:
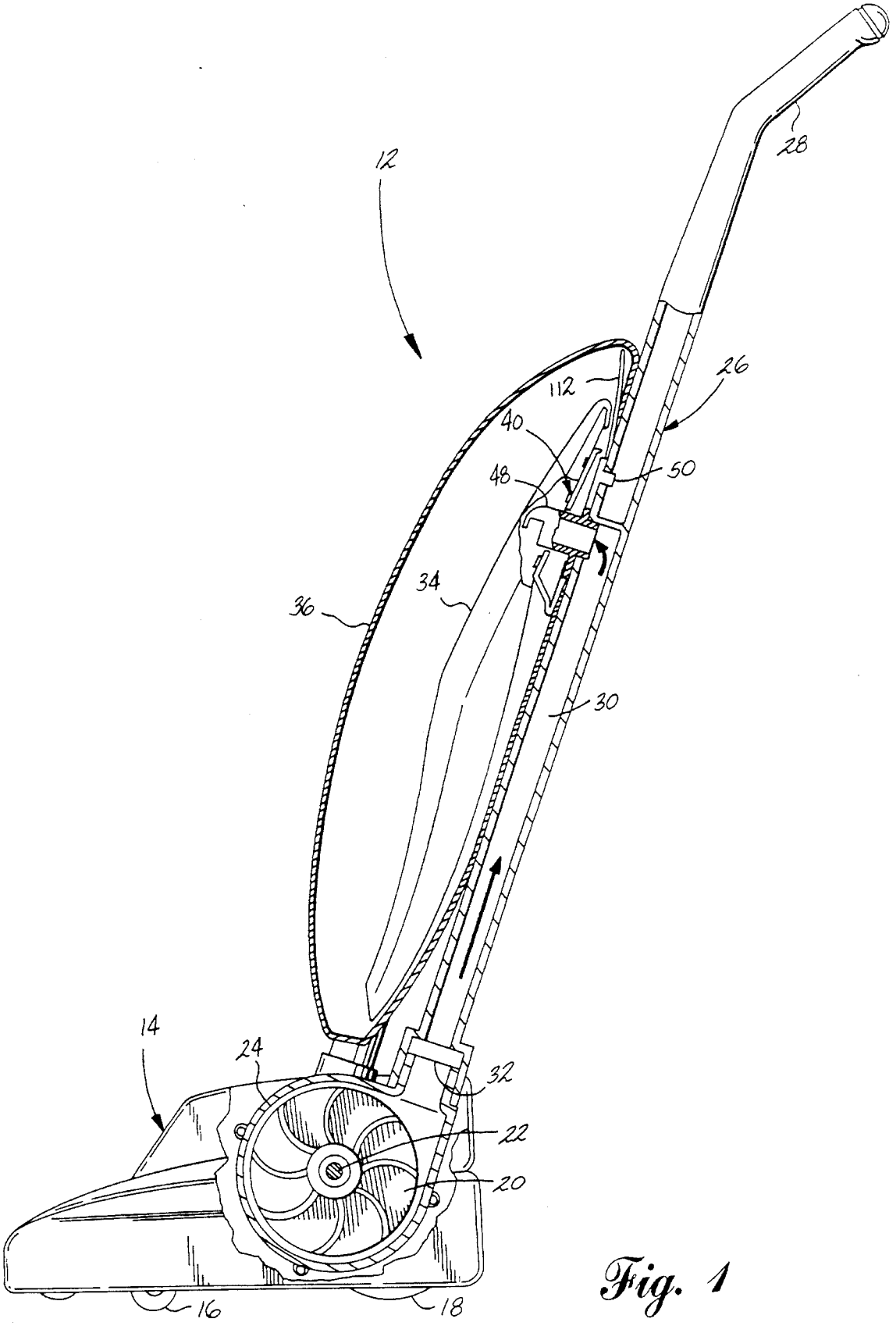
FIG. 1 is a partial sectional, side elevational view of a vacuum cleaner including the vacuum bag mounting assembly according to the invention.
Figure 3:
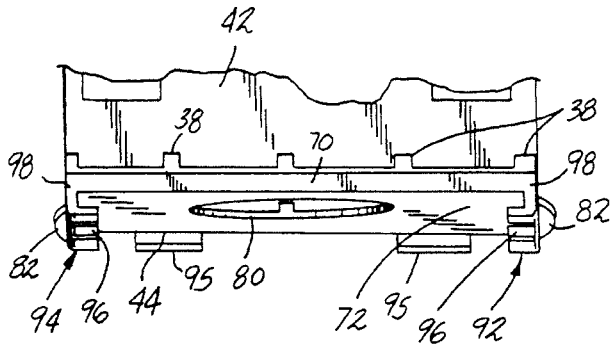
FIG. 3 is a side elevational view of the bag mounting member taken along lines 3—3 of FIG. 2.

Referring now to the drawings and to FIG. 1 in particular, a vacuum cleaner is shown having a foot 14 rollably supported on a surface to be cleaned by a pair of front wheels 16 and a pair of rear wheels 18. The foot 14 has an electric motor (not shown) mounted therein for rotating an impeller fan 20 in fan housing 24 of the foot 14. The impeller fan 20 is mounted to the drive shaft 22 of the motor which extends from the motor into the fan housing 24. The base of a handle 26 is mounted to the fan housing 24 and a grip 28 is formed at the upper end of the handle 26. At least a portion of the handle 26 is hollow and defines a working air conduit 30 extending between an exit aperture 32 of the impeller fan housing 24 and an outlet tube 48 which securely mounts a filter bag 34 at the terminal end of the working air channel 30. In the first embodiment, the filter bag 34 is enclosed by a permeable outer bag 36 which is mounted to the handle 26 in a conventional manner.

In operation, the motor (not shown) rotates the impeller fan 20 which draws dirt laden air through a nozzle opening (not shown) formed on the bottom surface of the foot 14. The dirt laden air is conveyed from the nozzle opening to the impeller fan housing 24 through a conventional working air channel of the foot 14. The rotating fan 20 forces the dirt laden air through the exit aperture 32 of the fan housing 24 into the working air channel 30 of the handle 26. The air passes through the working air channel 30 and out the outlet tube 48 into the filter bag. The filter bag is air permeable and filters most of the dirt and dust from an air stream passing therethrough. Dirt and dust is retained in the filter bag 34 while the air passes through the filter bag 34 and through the outer bag 36 to the external environment. The filter bag 34 is mounted to the handle 26 and vacuum housing by a bag mounting member 40.

Figure 4:
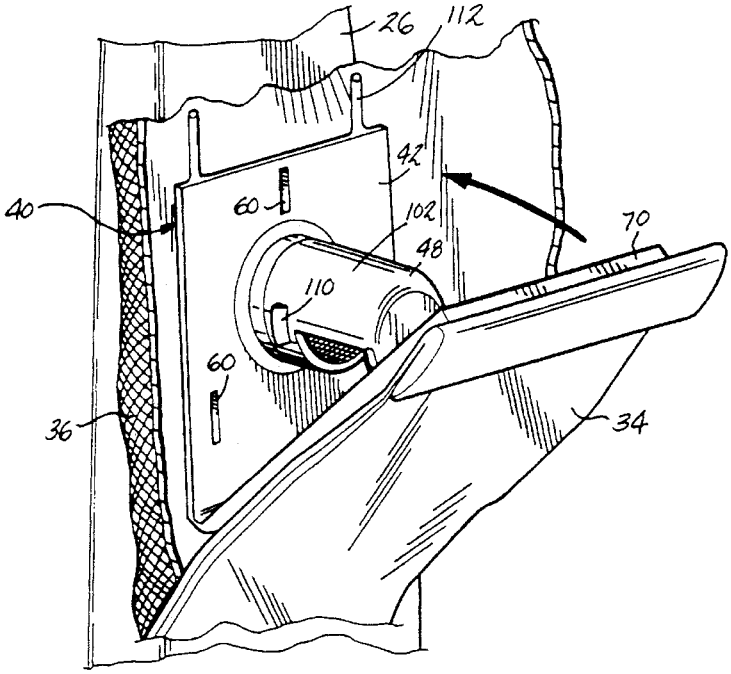
FIG. 4 is a perspective view of the bag mounting assembly at an intermediate position in the assembly process.
Figure 5:
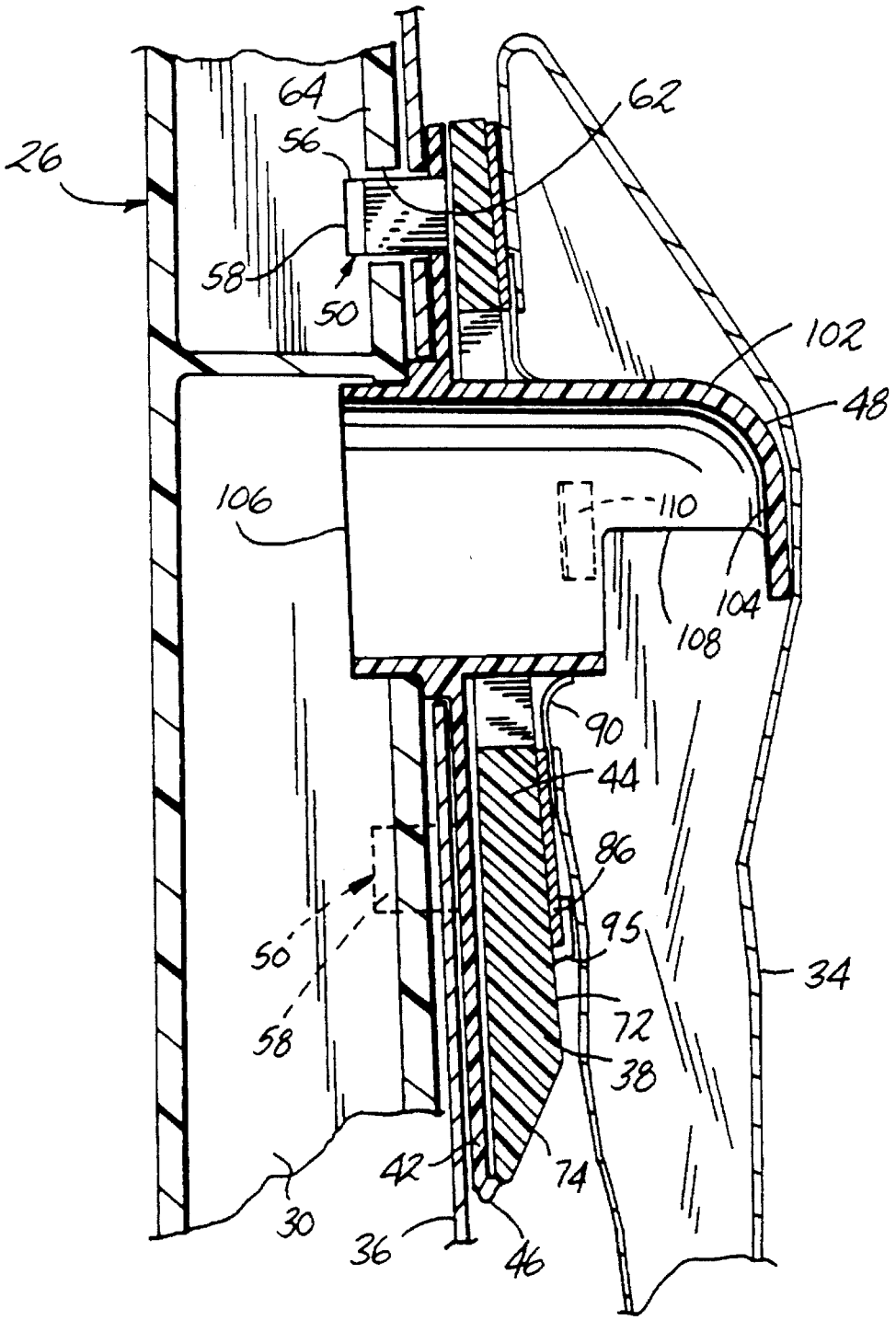
FIG. 5 is a sectional view of the bag mounting assembly in the assembled position.

As shown in FIGS. 2–5, the bag mounting member 40 comprises a fixed plate 42, a hinge plate 44 and a living hinge 46 interconnecting the bases of the fixed and hinge plates 42, 44. An outlet tube 48 is formed on the fixed hinge plate 42, extending through the fixed plate 42 and into the working air channel 30 of the handle 26. The outlet tube 48 projects into the filter bag 34 when the filter bag is mounted in the operative filtering position as illustrated in FIG. 5. Preferably, the fixed plate 42, hinge plate 44, living hinge 46 and outlet tube 48 are integrally molded as a single article by an injection molding process.

The fixed plate 42 has several mounting tabs 50 extending rearwardly from the rear surface 52 thereof. The mounting tabs 50 comprise a rearwardly extending flexible shaft 56 and a locking barb 58 formed at the end thereof. A core aperture 60 is formed in the fixed plate 42 immediately adjacent the base of the flexible shaft 56 of the mounting tab 50. During the injection molding operation, a conventional molding core (not shown) is inserted through the core aperture 60 to define part of the mold cavity for the formation of the shaft 56 and locking barb 58 of the mounting tab 50.

Figure 6:
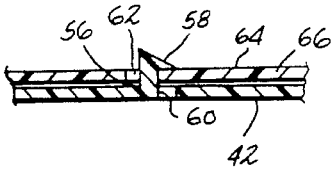
FIG. 6 is a sectional view along lines 6—6 of FIG. 2.
Figure 7:
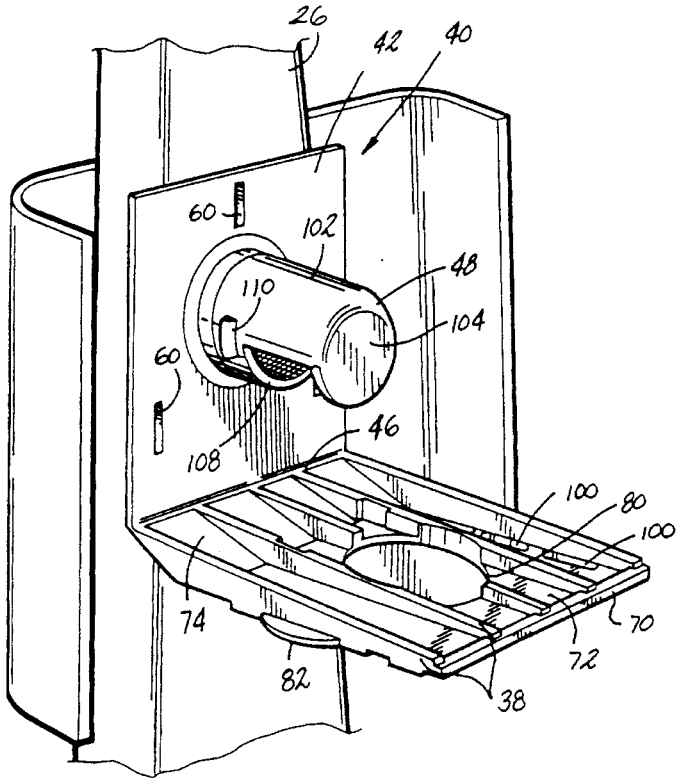
FIG. 7 is a perspective view of an alternative embodiment of a vacuum cleaner incorporating the vacuum bag mounting assembly according to the invention.

At least three mounting tabs 50 extend from the rear surface 52 of the fixed plate 42. The mounting tabs 50 are received in suitable mounting tab apertures 62 formed in the handle 26 in a position to avoid the working air channel 30. The bag mounting member 40 is easily snap-fit mounted to the handle 26 by inserting the mounting tabs 50 into the corresponding apertures 62. As the tabs 50 are received in the apertures 62, the locking barbs 58 contact an edge of the corresponding aperture 62, deflecting the shafts 56 of the tabs 50 laterally until the locking barb 58 extends beyond the rear surface 64 of the supporting wall 66. At this point, the shafts 56 of the tabs 50 will bias the locking barbs 58 to snap behind the rear surface 64 of the supporting wall 66, thereby securing the bag mounting assembly 42 to the handle 26. As shown in FIG. 6, the lower left one of the tabs 50 has a locking barb 58 which faces inwardly or to the right as viewed in FIG. 6. The other of the lower tabs 50, on the right side of the plate 42, faces inwardly toward the left as viewed in FIGS. 2 and 6 to resiliently retain the plate 42 on the supporting wall 66. A single upper tab 50 can face either to the right or left as viewed in FIG. 2.

The hinge plate 44 comprises an upper plate 72 and a lower plate 74. The upper plate extends downwardly from the top edge of the hinge plate 44 and laterally, in the forward direction from the fixed plate 42. The lower plate 74 extends upwardly from the living hinge 46 and laterally, in the forward direction from the fixed plate 42 to intersect the bottom of the upper plate 72. A plurality of support ribs 78 extend between the top edge 70 of the hinge plate 44, the living hinge 46 at the bottom of the hinge plate 44 and the rear surfaces of the two plates 72, 74 to lend rigidity to the hinge plate 44. The rear surfaces of the several support ribs 78 is planar. An air deflector aperture 80 is formed in the upper plate 72 and support ribs 78. Preferably, the aperture 80 is elliptical such that the longer axis of the aperture 80 extends between the top edge 70 and living hinge 46 and the shorter axis extends between the adjacent support ribs 78. The hinge plate 44 also includes a pair of tabs 82 which extend laterally outwardly from the outermost support rib 78, providing a grip for the user to grasp the hinge plate 44 and pivot it between the operative position illustrated in FIG. 5 and inoperative loading or loading position illustrated in FIG. 2.

A conventional filter bag 34 has a cardboard collar 86 surrounding a dirt receiving aperture 88 formed in the bag 34. An elastomeric sealing member 90 is mounted to the collar 86 immediately adjacent the dirt receiving aperture 88 and extends radially inwardly from the collar 86 to partially define the perimeter of the dirt receiving aperture 88.

The filter bag 34 is slidably received in a pair of opposed side channels 92, 94 and a pair of bottom channels 95 formed on the front surface of the upper plate 72. Each channel is defined by the front surface of the upper plate 72, a parallel leg 96 and a bight portion 98 interconnecting the leg 96 to the upper plate 72. The collar 86 is slidably received in the channels 92, 94 and 95 and positioned therein such that the sealing member 90 and dirt receiving aperture 88 are aligned with the air deflector aperture 80. The legs 96 of the channel members 92, 94 and 95 are formed during the injection molding process by cores (not shown) which extend through core apertures 100 formed in the upper plate 72. (See FIG. 2.)

The outlet tube 48 comprises an outwardly extending, tubular body 102 and a downwardly extending end wall 104. An entrance aperture 106 is formed in the end of the body 102 opposite the end wall 104 and an exit aperture 108 is formed in the lower portion of the body 102, adjacent the end wall 104. A pair of radially outwardly extending locking tabs 110 are formed on the outside surface of the body 102.

In operation, dirt laden air is conveyed through the working air channel 30 and enters the outlet tube 48 through the entrance aperture 106. The air passes through the hollow body 102 and is directed downwardly into the filter bag through the exit aperture 108 by the end wall 104.

The filter bag 34 is quickly and easily mounted to and removed from the outlet tube 48. First, the user slides the collar 86 of the filter bag 34 into the opposed channels 92, 94, 95 of the hinge plate 44 when the hinge plate 44 is in the loading condition shown in FIG. 2. The dirt receiving aperture 88 of the filter bag 34 is automatically aligned with the air deflector aperture 80 of the hinge plate 44 when the filter bag is properly seated in the channels 92, 94 and 95. The user then rotates the hinge plate 44 upwardly toward the fixed plate 42 about the axis of the living hinge 46. The elliptical-shaped opening of the air deflector aperture 80 is automatically aligned with and receives the outlet tube 48, accommodating the arcuate path of the filter bag resulting from the rotating motion of the hinge plate 44 about the hinge 46. As the hinge plate 44 rotates to receive the outlet tube 48, the elastomeric sealing member 90 will contact the exterior surface of the body 102 of the outlet tube 48. Preferably, the diameter of the opening of the elastomeric sealing member 90 is slightly smaller than the diameter of the outlet tube 48 to create a snug seal around the perimeter of the outlet tube 48. As the rotation of the hinge plate 44 nears the vertical position of the hinge plate 44, the sealing member 90 slides over the opposed locking tabs 110 formed on the outside surface of the body 102 of the outlet tube 48. When the hinge plate 44 reaches the substantially vertical position, the sealing member 90 has slid past the opposed locking tabs 110. In this position, the locking tabs 110 will resist the sliding movement of the sealing member from the body 102 of the outlet tube 48, thereby resisting the downward pivoting movement of the hinge plate 44 relative to the fixed plate 42. This interference fit between the sealing member 90 and the external surface of the body 102 of the outlet tube 48 is the only means necessary for retaining the hinge plate 44 in the upright position.

Figure 2:
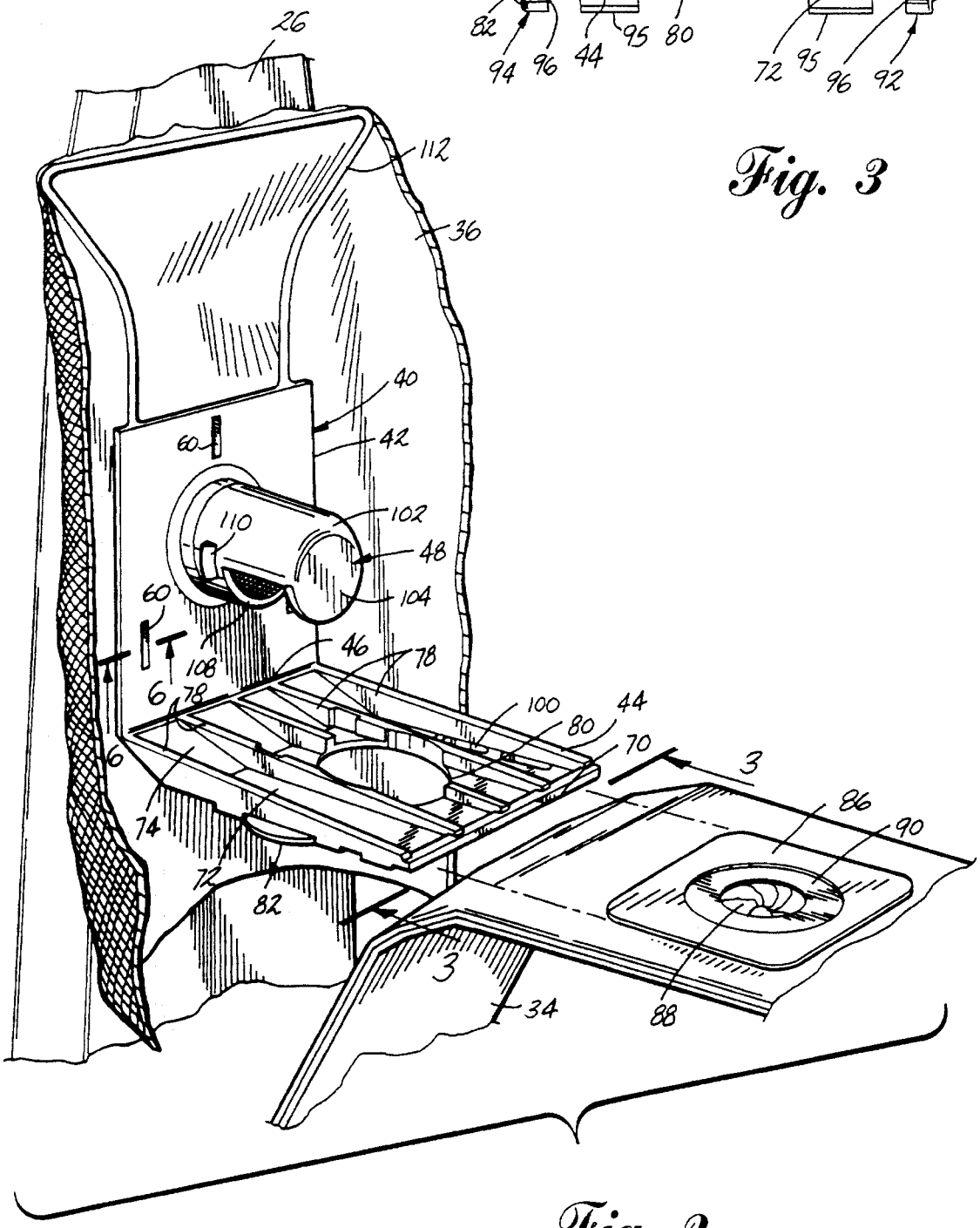
FIG. 2 is a partial, exploded view of the bag mounting assembly of FIG. 1.

As is evident above, the empty bag can be easily installed. When the filter bag 34 is full, the user merely grasps the tabs 82 formed on the sides of the hinge plate 44 and rotates the hinge plate downwardly relative to the fixed plate 42 about the living hinge 46. The elastomeric sealing member 90 will resist this motion. However, the amount of resistance will be minimal. The hinge plate 44 is rotated from the mounted position as seen in FIG. 5 to at least the intermediate position as seen in FIG. 4, or perhaps the horizontal position as seen in FIG. 2. Once the hinge plate 44 is in this position, the user easily slides the cardboard collar from the opposed channels 92, 94 and discards the used filter bag 34 and the contents thereof. A new bag is easily replaced as described above.

The filter bag mounting assembly according to the invention provides significant advantages over the prior art. As is evident from above, the pivoting construction of the bag mounting member results in a simple and efficient process for changing the filter bag. The motion of mounting the filter bag on the hinge plate 44 is intuitive to the user. Further, the rotation of the hinge plate 44 to the operative position is also intuitive to the user in that it is logical to rotate the hinge plate 44 upwardly, toward the handle and away from the user. This motion is contrasted with the lateral rotation of a mounting plate as is present, for example, in the mounting system described in U.S. Pat. No. 5,089,038. Further, because the hinge 46 extends across the hinge plate 44, the rotation of the hinge plate 44 follows a precise and predictable pattern so that the dirt receiving aperture 88 always aligns precisely with the outlet tube 48. The user thus does not have to perform the alignment function between the filter bag aperture 88 and the outlet tube 48 as may be required with prior filter bag mounting devices as, for example, in U.S. Pat. No. 3,683,599.

The structure of the outlet tube 48 also protects the filter bag 34 from damage during operation. Dirt and debris entrapped within the vacuum air flow is drawn upwardly through the working air channel 30 and then is deflected laterally into the hollow body of the outlet tube 48. As the air passes through the tube 48, the end wall 104 deflects the dirt-laden air downwardly into the filter bag 37. Large, sharp objects which are entrapped within the air flow strike the end wall 104 and lose a significant amount of the kinetic energy before entering the filter bag 34. Rather, the object will fall into the filter bag with significantly less momentum. With this structure, it is less likely that the object will tear or puncture the filter bag. The full area of the bag can be used for filtration. Without the end wall 104, the bag may require a lap joint or reinforcement opposite the outlet tube 48. The shape of the end wall 104 also reduces noise associated with the air flow.

Still another advantage of the bag mounting member according to the invention is the ease of manufacturing. The bag mounting member 40 has been specifically designed to be integrally molded as a single article in a single injection-molding operation. The fixed plate 42, hinge plate 44, living hinge 46, and outlet tube 48 are molded in a pair of simple, horizontally oriented mold halves. Projecting mold cores are mounted in the mold halves for formation of the mounting tabs 50, outlet tube 48 and channels 92, 94. In addition, the outlet tube 48 is contoured such that the locking tab 110 can be integrally formed thereon. Preferably, the locking tab 110 extends outwardly from the surface of the outlet tube 48 approximately 0.3 inches. With this structure, the mounting member can be removed from the mold assembly without damaging the molded product. Significant manufacturing costs are achieved through the one-piece molding of the bag mounting member 40 as a direct result of the reduction in tooling and labor required to assemble this structure from multiple, individual components.

The bag mounting assembly 40 according to the invention can be used with a soft-bag upright vacuum cleaner as shown in FIGS. 1–4 or a hard-housing vacuum cleaner as shown in FIG. 6. When the bag mounting member 40 is used in a soft upright vacuum bag 36, a bag support member 112 can be integrally molded to the top edge of the fixed plate 42. The bag support member 112 holds the upper corners of the bag 36 at a predetermined position during operation and storage of the vacuum cleaner.

As illustrated in FIG. 6, the bag mounting member 40 can also be adapted for use in a hard-housing upright vacuum cleaner. In this form of vacuum cleaner, a rigid shell 120 replaces the flexible outer bag 36 of the soft-bag vacuum cleaner of FIGS. 1–4. The shell 120 is securely mounted to the handle 26 by conventional means. The bag mounting member 40 has the same structure and operation when incorporated in the hard shell vacuum cleaner as the soft bag cleaner. Apertures (not shown) are formed in the rear wall of the shell 120 for receipt of the mounting tabs 50 in securing the bag mounting member 40 to the handle 26. In the rigid shell, the working air conduit 30 extends up through the interior of the filter housing.

As is evident from above, the bag mounting assembly according to the invention provides significant advantages of ease of use and reduced manufacturing costs over the prior art bag mounting systems. The bag mounting system is accurate and intuitive for customer use. This will result in increased consumer satisfaction and cost reduction.

Reasonable variation and modification are possible within the scope of the foregoing description and drawings without departing from the spirit of the invention which is defined in the appended claims.

What is claimed is:

1. An improved vacuum cleaner comprising:

a vacuum housing, a suction nozzle mounted to the vacuum housing adapted to collect dirt from a surface to be cleaned;

a filter enclosure mounted to the housing;

a working air conduit extending from the suction nozzle to the filter enclosure and defining a working air flow path therebetween;

a vacuum motor in the vacuum housing connected to the working air conduit and adapted to draw air from the nozzle through the working air conduit and force the air into the filter enclosure;

a filter bag having an aperture formed therein to filter dirt from dirt laden air and a mounting collar secured to the bag;

a first mounting member mounted to the vacuum housing and having an outlet opening coupled to the working air conduit;

a second mounting member removably mounting the filter bag thereto;

a hinge pivotally interconnecting the first and second mounting members for rotational movement of the second mounting member with respect to the first mounting member between a first position wherein the filter bag aperture is in fluid communication with the first mounting member outlet opening and a second position wherein the filter bag aperture is pivoted out of fluid communication with the outlet opening for removal and replacement of the filter bag, characterized in that:

the hinge is integrally molded to the first and second mounting members.

2. An improved vacuum cleaner according to claim 1 wherein the first member outlet opening comprises an outlet tube mounted to and extending from the working air conduit and into the filter enclosure, and the outlet tube has at an outer end a deflector to change the direction of air passing through the outlet tube to prevent particles entrained in the air from damaging the filter bag.

3. An improved vacuum cleaner according to claim 2 wherein the second mounting member has formed therein a conduit aperture which receives the outlet tube when the second mounting member is rotated to the first position.

4. An improved vacuum cleaner according to claim 3 wherein the filter bag aperture has a first diameter and the outlet tube has at least one bag retaining projection extending outwardly therefrom, the at least one projection and air conduit defining a second diameter which is slightly smaller than the first diameter, the at least one projection being mounted to the air conduit such that the air conduit aperture of the bag slides over the at least one projection when the second mounting member is pivoted between the first and second positions, the frictional interference between the filter bag and the at least one projection being sufficient to retain the second mounting member in the first position during normal operating conditions of the vacuum cleaner.

5. An improved vacuum cleaner according to claim 4 wherein the conduit aperture of the second mounting member is elliptically shaped with the longer axis of the aperture perpendicular to the axis of rotation of the hinge and the shorter axis of the aperture parallel to the axis of rotation of the hinge.

6. An improved vacuum cleaner according to claim 1 and further comprising at least one mounting tab extending laterally from one of the housing and first mounting member and at least one mounting tab aperture formed in the other of the housing and first mounting member, the at least one mounting tab being received in the at least one aperture to mount the first mounting member to the housing.

7. An improved vacuum cleaner according to claim 6 wherein the at least one mounting tab comprises a flexible shaft extending outwardly from said one of the housing and first mounting member and a locking head on an outer end of the shaft, the head being received in the at least one mounting tab aperture for snap-locking the first mounting member and housing to one another.

8. An improved vacuum cleaner according to claim 1 wherein the second mounting member comprises:

a top edge and a bottom edge, the top and bottom edges defining a first plane;

an upper portion extending downwardly from the top edge along a second plane; and a lower portion extending upwardly from the bottom edge along a third plane which intersects the second plane of the upper portion, the intersection of the second and third planes being spaced forward from the first plane.

9. An improved vacuum cleaner according to claim 8 wherein the second mounting member further comprises a pair of opposed L-shaped flanges extending outwardly from the upper portion to define therewith a pair of opposed U-shaped channels, and a bottom flange, the U-shaped channels adapted to slidably receive the bag collar, the bottom flange adapted to align the filter bag aperture with the outlet opening in the first mounting member.

10. An improved vacuum cleaner according to claim 1 wherein the filter enclosure comprises a flexible air permeable bag and further comprising a bag support member integrally molded to and extending upwardly from the first mounting member; and the flexible air permeable bag is mounted to the bag support member.

11. An improved vacuum cleaner according to claim 1 wherein said outlet opening on said first mounting member comprises an outlet tube extending into said filter enclosure and wherein the filter bag aperture of the bag has a first diameter and the outlet tube has at least one bag retaining projection extending outwardly therefrom, the at least one projection and air conduit defining a second diameter which is slightly smaller than the first diameter, the at least one projection being mounted to the air conduit such that the air conduit aperture of the bag slides over the at least one projection when the second mounting member is pivoted between the first and second positions, the frictional interference between the filter bag and the at least one projection being sufficient to retain the second mounting member in the first position during normal operating conditions of the vacuum cleaner.

12. An improved vacuum cleaner according to claim 1 wherein said filter enclosure is a rigid housing.

13. An improved vacuum cleaner comprising:

a vacuum housing, a suction nozzle mounted to the vacuum housing adapted to collect dirt from a surface to be cleaned;

a filter enclosure mounted to the housing;

a working air conduit extending from the suction nozzle to the filter enclosure and defining a working air flow path therebetween;

a vacuum motor in the vacuum housing connected to the working air conduit and adapted to draw air from the nozzle through the working air conduit and force the air into the filter enclosure;

a filter bag having an aperture formed therein to filter dirt from dirt laden air and a mounting collar secured to the bag;

a first mounting member mounted to the vacuum housing and having an outlet opening coupled to the working air conduit;

a second mounting member removably mounting the filter bag thereto;

a hinge pivotally interconnecting the first and second mounting members for rotational movement of the second mounting member with respect to the first mounting member between a first position wherein the filter bag aperture is in fluid communication with the first member outlet opening and a second position wherein the filter bag aperture is pivoted out of fluid communication with the outlet opening for removal and replacement of the filter bag, characterized in that:

at least one of the first mounting member and the housing has mounting tabs extending therefrom and the other of the first mounting member and the housing has apertures in registry with the mounting tabs, the mounting tabs being received within the mounting tab apertures to retain the first mounting member on the housing.

14. A vacuum cleaner according to claim 13 wherein the or each of the mounting tabs have a flexible shaft and a locking head on the end of the shaft, the head being received behind the other of the first mounting member and the housing in snap-fit relationship thereto.

* * * * *